US009527086B2

(12) United States Patent
Johansson et al.

(10) Patent No.: US 9,527,086 B2
(45) Date of Patent: Dec. 27, 2016

(54) FRAME FOR A GYRATORY CRUSHER

(75) Inventors: Henrik Johansson, Malmo (SE); Martin Nilsson, Vellinge (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 14/124,258

(22) PCT Filed: May 29, 2012

(86) PCT No.: PCT/EP2012/059962

§ 371 (c)(1),
(2), (4) Date: Dec. 16, 2013

(87) PCT Pub. No.: WO2013/007440

PCT Pub. Date: Jan. 17, 2013

(65) Prior Publication Data

US 2014/0103154 A1 Apr. 17, 2014

(30) Foreign Application Priority Data

Jun. 7, 2011 (EP) ..... 11168977

(51) Int. Cl.
*B02C 2/04* (2006.01)

(52) U.S. Cl.
CPC *B02C 2/04* (2013.01); *B02C 2/042* (2013.01)

(58) Field of Classification Search
CPC ..... B02C 2/005; B02C 2/045; B02C 2/02; B02C 2/04; B02C 2/042
USPC ..... 241/37, 207–216
See application file for complete search history.

(56) References Cited

U.S. PATENT DOCUMENTS

| | | | | |
|---|---|---|---|---|
| 2,670,142 | A * | 2/1954 | Gruender | 241/208 |
| 3,774,858 | A * | 11/1973 | Archer | B02C 2/04 241/285.1 |
| 4,477,030 | A * | 10/1984 | Vifian et al. | 241/208 |
| 4,750,681 | A * | 6/1988 | Sawant et al. | 241/208 |
| 5,031,843 | A * | 7/1991 | Motz | 241/21 |
| 6,000,648 | A * | 12/1999 | Ambrose | 241/215 |
| 6,446,892 | B1 * | 9/2002 | Fasoli | B02C 2/04 241/207 |
| 7,036,758 | B2 * | 5/2006 | Hamada | B02C 2/005 241/207 |
| 2004/0035967 | A1 * | 2/2004 | Johnson et al. | 241/207 |

FOREIGN PATENT DOCUMENTS

| | | |
|---|---|---|
| GB | 1223735 A | 3/1971 |
| WO | 0021672 A1 | 4/2000 |

* cited by examiner

*Primary Examiner* — Faye Francis
*Assistant Examiner* — Onekki Jolly
(74) *Attorney, Agent, or Firm* — Corinne R. Gorski

(57) ABSTRACT

A gyratory crusher includes a frame and a crushing head which is arranged rotatably about a substantially vertical shaft. The frame has an upper frame portion and a lower frame portion. The lower frame portion includes a hub. The hub has a centralized arranged through hole with a center axis extending through the hole and the hub. The hole is arranged to cooperate with the shaft being rotatably arranged in the hole. The hub is connected by arms to the lower frame portion and includes a drive ring pocket.

9 Claims, 5 Drawing Sheets

30"
90 kW, 395 rpm, 5 t

36"
150 kW, 360 rpm, 9 t

44"
220 kW, 320 rpm, 14 t

52"
315 kW, 290 rpm, 24 t

60"
520 kW, 280 rpm, 50 t

76"
600 kW, 230 rpm, 70 t
1

FRAME FOR A GYRATORY CRUSHER

RELATED APPLICATION DATA

This application is a §371 National Stage Application of PCT International Application No. PCT/EP2012/059962 filed May 29, 2012 claiming priority of EP Application No. 11168977.4, filed Jun. 7, 2011.

TECHNICAL FIELD OF THE INVENTION

The present invention relates to an gyratory crusher used for crushing, and can be suitably used in the construction and mining industries.

BACKGROUND ART

Upon fine crushing of hard material, e.g. stone blocks or ore blocks, material is crushed that has an initial size of approx. 100 mm or less to a size of typically approx. 0-25 mm. Crushing, e.g. fine crushing, is frequently carried out by means of a gyratory crusher. Known crushers have an outer shell that is mounted in a stand. An inner shell is fastened on a crushing head. The inner and outer shells are usually cast in manganese steel, which is strain hardening, i.e. the steel gets an increased hardness when it is exposed to mechanical action. A known gyratory crusher has a driving device for crushing the material between the inner and outer shells in a known way.

However, about 125 years have passed since the first gyratorycrusher was created, and such crushers are now used almost everywhere in the world, but its basic design has not changed. Hence, if the crushing force in a gyratorycrusher is to be increased, e.g. by 20% to improve the crushing capacity, the crusher designers have hitherto conventionally only "upscaled" the crusher, i.e. most of the dimensions of a smaller crusher has been increased in an enlarged scale being proportional to the increased crushing force to be able to carry and withstand the increased crushing force. This enlargement of known crushers increases both their own/tare weight and their outer dimensions in proportion to the increased crushing force. This is shown in FIGS. 1 to 6 where increasing crusher capacities and crushing forces requires the conventional enlarging of the crushers "all-over" in proportion to the increased crusher force from the smallest crusher in FIG. 1 to the largest crusher in FIG. 6.

SUMMARY OF THE INVENTION

It is an object of the invention to provide a gyratory crusher, which solve, or at least lessen, the problems mentioned above.

It is an object of the invention to provide a gyratory crusher enabling the use of the same foundation for an old crusher when replacing it with this inventive crusher as its outer dimensions are kept the same as the old crusher and fits onto the old foundation.

Another object of the invention is to provide a gyratory crusher that reduces the number of crusher parts and dimensions that have to be enlarged for carrying the increased crushing force and stresses associated therewith.

Yet another object of the invention is to provide a gyratory crusher that reduces its own weight compared to conventionally only enlarging most parts of a crusher for carrying an increased crushing force and stresses associated therewith, i.e. the inventive crusher has an optimized tare weight and load carrying ratio compared to known crushers.

These objects are achieved by means of a gyratory crusher, as claimed in the associated independent claim, preferred variants thereof being defined in the associated dependent claims.

The gyratory crusher according to the independent crusher claim makes it possible to increase crushing force while maintaining the outer dimensions of the whole crusher enabling assembly of the inventive crusher on an old foundation for a corresponding old crusher when replacing the old crusher.

The gyratory crusher according to the independent crusher claim also makes it possible to increase crushing force while maintaining the dimensions of most of the other parts of the whole crusher, wherefore the weight of the crusher is not increased to the same extent as would be the case if the crusher was only enlarged in the conventional way "all-over".

The gyratory crusher according to the independent crusher claim also makes it possible to increase crushing force by only enlarging the dimensions of one part of the crusher instead of enlarging most of the other parts of the whole crusher, wherefore the work in designing and manufacturing the crusher is simplified and requires less effort in man hours compared to the conventional way of enlarging most parts of the crusher, i.e. in view of the whole chain of design and manufacture.

The gyratory crusher according to the independent crusher claim makes it possible to increase crushing force by only enlarging the dimensions of one part of the crusher for increasing stress support while minimizing crusher frame mass. This is done, in particular, by only enlarging one part, i.e. the hub of the crusher frame, for improving the stiffness of the lower crusher frame portion, wherefore the stresses in a so called "hot spot", i.e. the weakest part of the design, is reduced. Hence, the high amplitude stresses in the hub area, in particular compressive stresses, are reduced eliminating crack formation in that area. Moreover, the gyratory crusher according to the independent crusher claim also improves the castability of the lower crusher frame portion.

In some embodiments/aspects, the drive ring pocket is bounded by an inner wall element and an outer wall element of the hub arranged at a distance from each other and the radial thickness of the waist portion is at least as thick as the sum of the radial thickness of the inner wall element and the width of the drive ring pocket (64). Thereby, the waist portion is thicker and stiffens the wall elements and the drive ring pocket from below and the hub from the outside, which increases the ability for the hub to withstand increased crushing forces.

In some embodiments/aspects, the hub comprises a hub bottom end and the radial thickness of the waist portion decreases towards the hub bottom end. Thereby, the waist portion is thicker closer to the wall elements forming a cantilever effect where the need for support is the largest, which increases the ability for the hub to withstand increased crushing forces.

In some embodiments/aspects, the hub comprises a hub bottom end, which comprises a wall element being a prolongation of the inner wall element for the hub in the direction of the centre axis, and the radial thickness of the wall element of the hub bottom end is substantially the same as the radial thickness of the inner wall element for the hub. Thereby, the waist portion is thicker closer to the wall elements forming a cantilever effect where the need for support is the largest but thinnest at the area where the need of support is the smallest, which increases the ability for the hub to withstand increased crushing forces while optimizing the amount of material used for the support.

In some embodiments/aspects, the arms of the lower frame portion are hollow and the waist portion is arranged between the arms of the lower frame portion. Similarly, this also increases the ability for the hub to withstand increased crushing forces while optimizing the location and the amount of material used for the support.

In some embodiments/aspects, the waist portion extends in the circumferential direction of the hub to and joins the arms of the lower frame portion. Thereby, the ability to withstand an increased crushing force is increased further, since the waist portion supports the arms from the hub outer wall to a distance that is as far from the hub outer wall as possible in relation to the extension from the hub of the arm for shortening the overhang of the arm as much as possible.

In some embodiments/aspects, the waist portion extends to and joins each arm of the lower frame portion by means of a transition section at each end of the waist portion forming a smooth connection between the waist portion and each arm. Similarly, the ability to withstand an increased crushing force is increased further, since the waist portion smears out the radius and increases the radius at the corner junction between the hub and the arms such that the stresses at the corner junction is reduced.

In some embodiments/aspects, the drive ring pocket of the hub is further bounded by a bottom wall element, which bottom wall element has a thickness in the direction of the centre axis being larger than the radial thickness of the inner wall element for the hub. Thereby, the bottom wall element thickens the waist portion forming a cantilever effect where the need for support is the largest, which increases the ability for the hub to withstand increased crushing forces while optimizing the location and the amount of material used for the support.

In some embodiments/aspects, the thickness of the bottom wall element in the direction of the centre axis is smaller than the distance from the bottom of the drive ring pocket to the hub bottom end. Similarly, the bottom wall element thickens the waist portion forming a cantilever effect where the need for support is the largest but makes the waist portion thinner at the area where the need of support is smaller, which increases the ability for the hub to withstand increased crushing forces while optimizing the location and the amount of material used for the support.

In some embodiments/aspects, the waist portion extends discontinuously around the circumference of the hub. Similarly, the discontinuously extending waist portion forms a cantilever effect where the need for support is the largest but does not extend at the area where the need of support is smaller, which increases the ability for the hub to withstand increased crushing forces while optimizing the location and the amount of material used for the support.

The effect of the invention is that the total stress is reduced by at least 35% and enables an increase of the crusher load by more than 25%.

BRIEF DESCRIPTION OF THE DRAWINGS

The invention will be described in more detail with reference to the appended drawings, which show examples of presently preferred embodiments of the invention.

DETAILED DESCRIPTION OF THE INVENTION

Figures 1, 2, 3, 4, 5, 6:
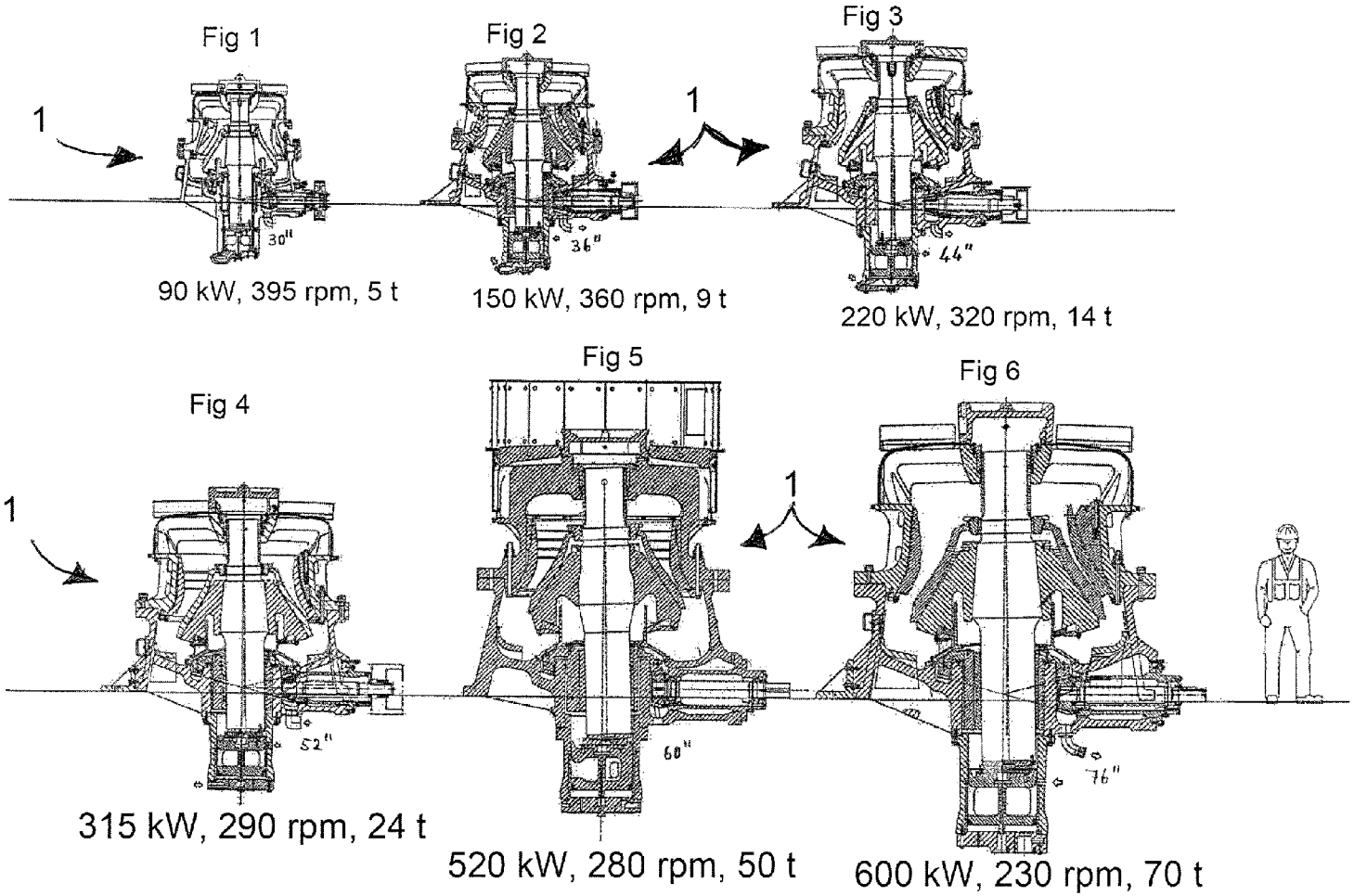
FIGS. 1 to 6 show prior art crushers that in the hitherto conventional way in response to increasing crusher capacities and crushing forces have been developed by "upscaling", i.e. enlarging the dimensions of the whole known crushers in proportion to the increased crusher force stepwise from the smallest crusher in FIG. 1 to the largest crusher in FIG. 6.

Prior art crushers 1 are shown in FIGS. 1 to 6. The gyratorycrusher 10 according to the invention is shown in FIGS. 7 to 10. The gyratory crusher has a frame 40, which comprises an upper frame portion 41 and a lower frame portion 42 comprising a hub 43. A vertical central shaft 60 is supported by the lower frame portion of the frame 40, via a spherical support in a cylinder-piston assembly 30 comprising a thrust bearing arranged on a piston of a hydraulic cylinder disposed in the frame 40. An eccentric 61 is rotatably arranged about the central shaft 60, i.e. mounted on the shaft, which excenter is adapted to rotate about said shaft. A crushing head 70 is mounted about the central shaft, and thus indirectly in the eccentric 61. A drive shaft 65 is arranged to cause the eccentric 61 to rotate about the central shaft 60 by means of a conical gear wheel engaging with a gear rim connected to the eccentric. The gear rim connected to the eccentric forms a drive ring 63 and is comparted in a drive ring pocket 64 from the shaft 60. The eccentric comprises a hole through which the shaft is arranged, which hole is displaced in relation to a centre axis 80 of the hub 43 and slightly inclined relative to the vertical plane to accommodate the tilting shaft, which is per se known in the art. Because of the displacement of the hole of the eccentric 61 and the shaft, the crushing head 70 will also be slightly inclined relative to the vertical plane. The hub 43 is connected to the outer part of the lower frame portion 42 by hollow arms 44.

Figure 7:
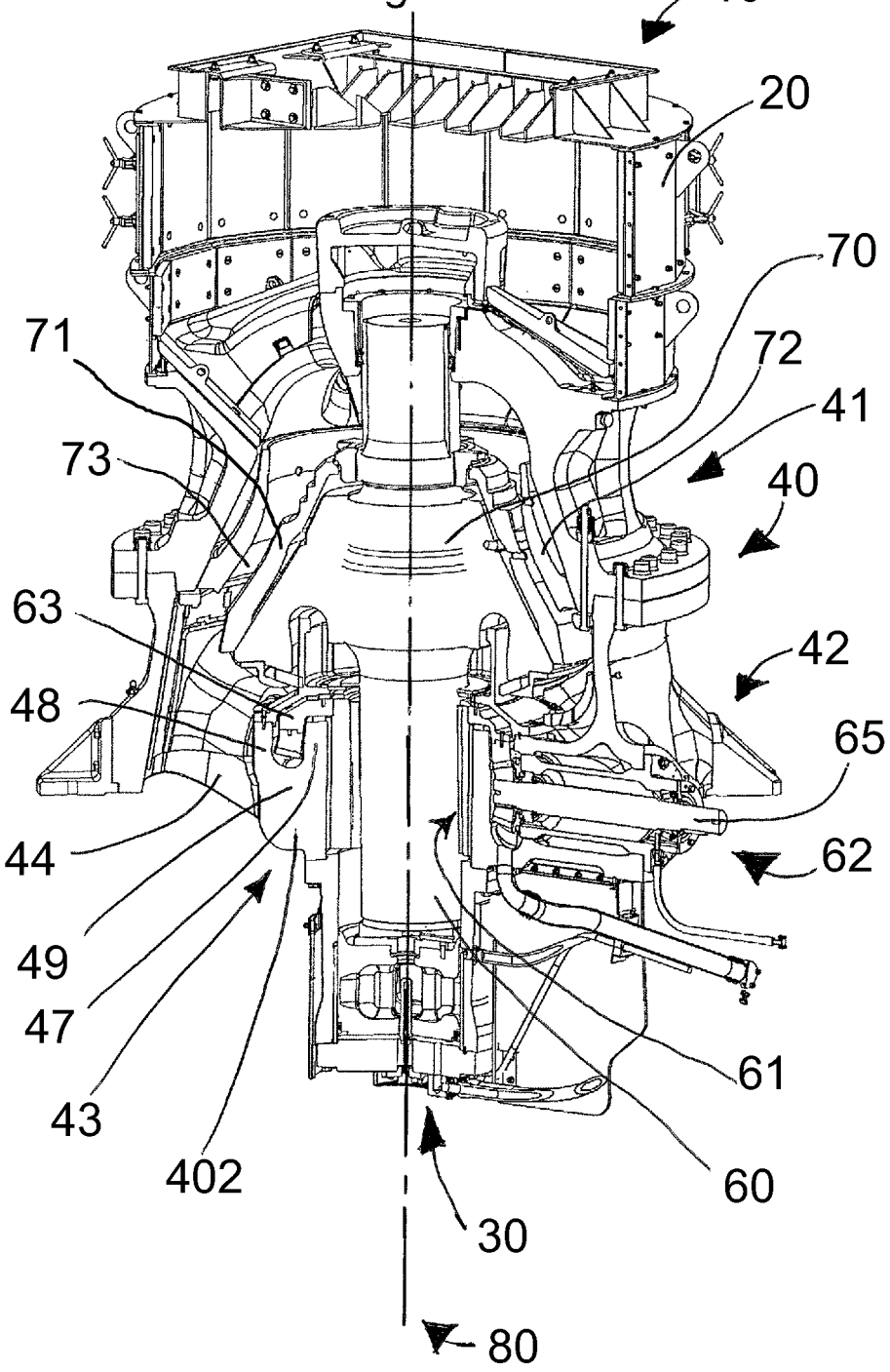
FIG. 7 is a perspective view of the gyratory crusher according to the invention partly cut out for showing the inner parts of the crusher.

A first crushing shell 71 is fixedly mounted on the crushing head 70 being fixedly mounted to the shaft 60. A second crushing shell 72 is fixedly mounted on the upper frame portion 41. Between the two crushing shells a crushing gap 73 is formed, i.e. delimited, the width of which, in axial section as illustrated in FIG. 7, decreases in the downward direction. When the drive shaft 65 (shown in FIG. 7) accommodated in one of the arms 44, during operation of the crusher 10, rotates the eccentric 61, the crushing head will execute a gyrating movement that drives the first crushing shell being an internal cone. A material to be crushed is introduced in the crushing gap 73 and is crushed between the first crushing shell and the second crushing shell as a result of the gyrating movement of the crushing head, during which movement the two crushing shells alternately approach and move away from one another in a gyratory pendulum motion, i.e. a motion during which the inner first crushing shell and the outer second crushing shell approach each other along a rotary generatrix and retreat from each other along another diametrically opposite generatrix. The crushing head, and the first crushing shell mounted thereon, will be in rolling engagement with said second crushing shell by way of the material to be crushed. This rolling engagement causes the first crushing shell, crushing head and the shaft to rotate slowly together in a direction of rotation that is substantially opposite to the direction of rotation of the eccentric 61 during crushing.

A feed hopper 20 is also detachably mounted onto the upper crusher frame portion 41 to function as a first inlet of material to be crushed (see FIG. 7), which feed hopper and its function is known per se.

The upper frame portion 41 also forms an inlet of material to be crushed, and the lower frame portion 42 forms, in principle, an outlet for the crushed material. The hub 43 supports the shaft 60 and is a centre hub of the crusher 10 in the lower frame portion 42. The lower frame portion is fenestrated for letting through crushed material.

The number of arms 44 depends on the size of the crusher 10 and may be between three and up to six, but is preferably between four and five. The hub 43 has one hub top end 45 facing the inlet of material to be crushed, e.g. the feed hopper 20, and one hub bottom end 46 at the outlet for the crushed material. The hub top end 45 comprises an inner wall element 47 and an outer wall element 48. The inner wall element 47 is arranged radially closer to the shaft 60, i.e. inwards of the hub and in relation to the outer wall element 48. The hub bottom end 46 comprises a wall element 401 being a prolongation of the inner wall element 47 for the hub top end 45 in the longitudinal direction of the hub 43.

Figure 8:
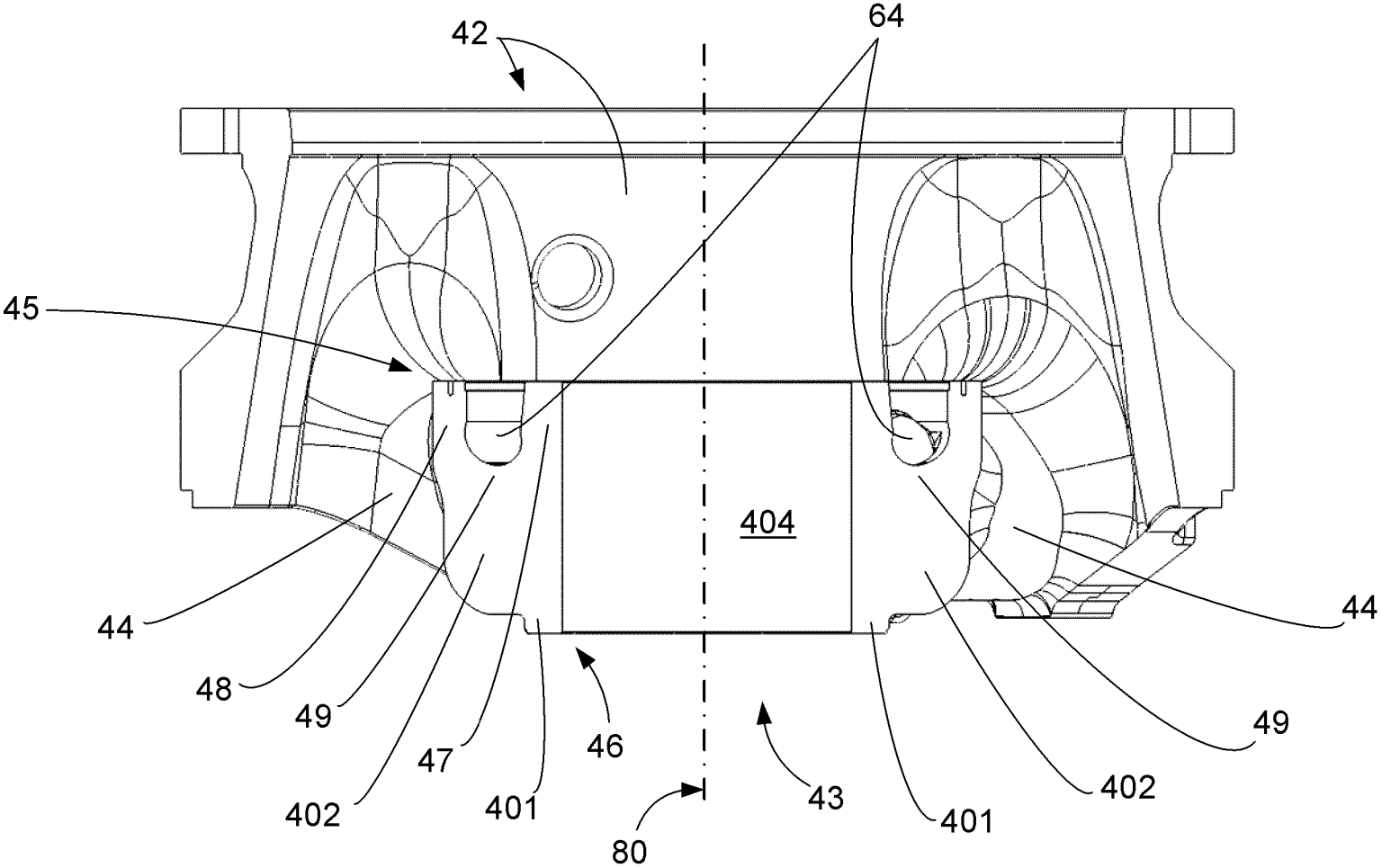
FIG. 8 is a view in cross-section showing only a lower part of the crusher in FIG. 7, i.e. an inner hub of the lower part with an outer portion of the lower crusher part cut away through arms connecting the hub to this not shown outer part.
Figure 9:
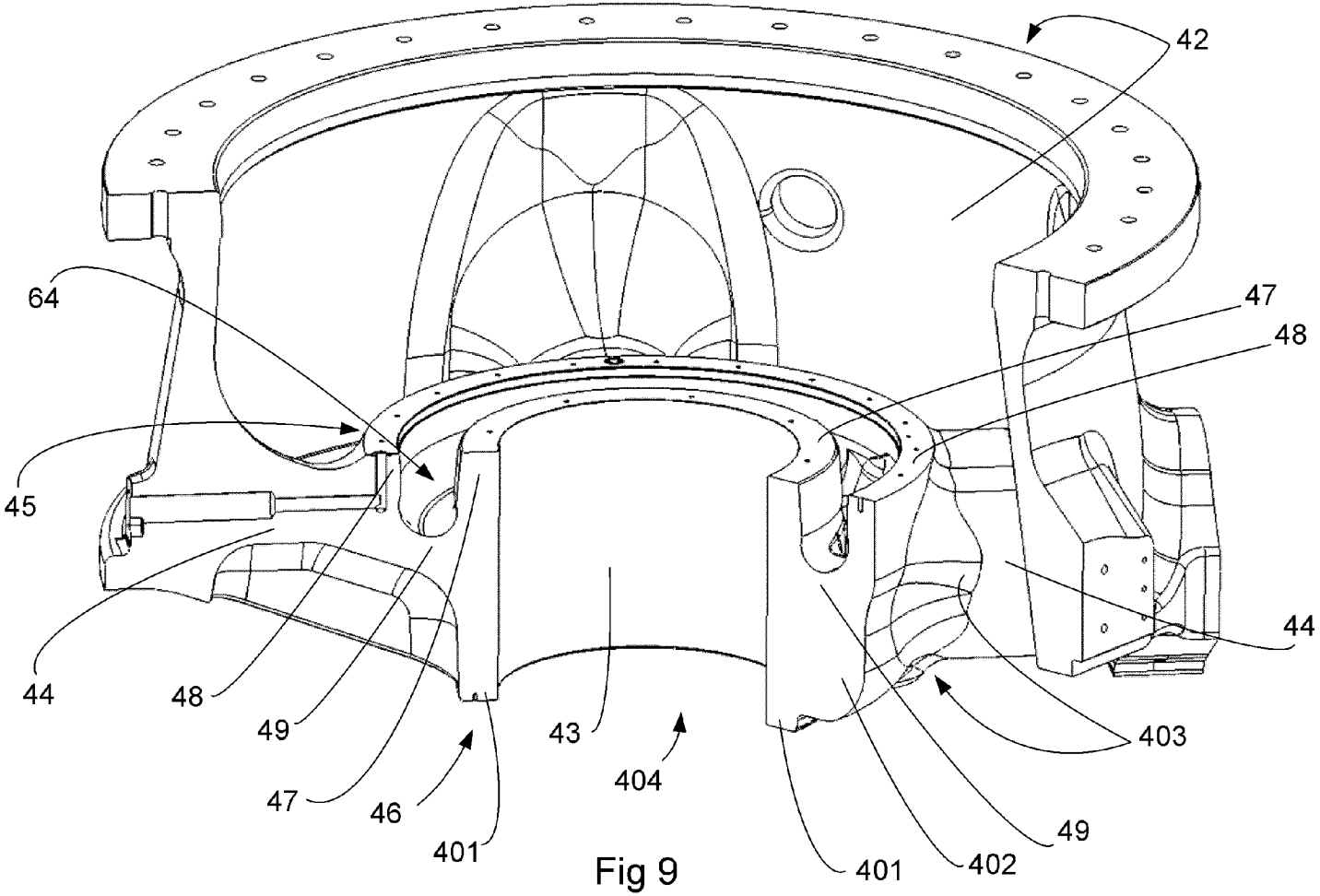
FIG. 9 is a perspective view showing the lower part of the crusher in FIG. 8.

The hub 43 is provided with a waist portion 402 with a radial thickness being larger than the width of the drive ring pocket 64 for the hub. This is shown in FIGS. 8 to 9. The waist portion extends in the circumferential direction of the hub 43 to the arms of the lower frame portion 42, and joins the arms 44 of the lower frame portion. The waist portion 402 extends to and joins each arm of the lower frame portion 42 by means of a radial junction and/or transition section at each end 403 of the waist portion. Each transition section at each waist portion end 403 adjoins each arm and forms a smooth connection between the waist portion and each arm. This thickening of the adjoining corner area between the outer surface of the hub and the outer surface of each arm by means of the waist portion 402 smoothens out the radius at these corner areas on each side of each arm, wherefore stresses at those corner areas are distributed over a larger area/volume. The adjoining surfaces of the waist portion end 403 and each arm increases the thickness of the arm at that corner area. The waist portion end 403 and its material may be seen as being, in principle, plastered or putty up onto the outer surface of the hub, and upon each side of each arm a distance along the outside of each arm. This "extra" waist portion material can be seen as an additional support that shortens the length of the momentum arm or the overhang of each arm and stiffens each arm at the concerned corner area. This additional material of each waist portion end 403 being smeared upon each arm forms an additional surface or contact area that facilitates the distribution of stresses at this area between the waist portion 402, the hub and the arm.

The two inner and outer wall elements 47 and 48 of the hub top end 45 are placed at a distance from each other in the radial direction of the hub 43 for forming a gap between them. This gap forms a cavity, i.e. the drive ring pocket 64 for the drive ring 63.

The radial thickness of the waist portion 402 is at least as thick as the sum of the radial thickness of the inner wall element 47 and the distance between the inner wall element and the outer wall element 48, i.e. the width of the drive ring pocket 64 in the radial direction, i.e. substantially perpendicular to the longitudinal axis of the hub 43. Moreover, the radial thickness of the waist portion 402 may be thicker than the sum of the radial thickness of the inner wall element 47 and the distance between the inner wall element and the outer wall element 48. The radial thickness of the waist portion 402 may be substantially the same as the sum of the radial thickness of the inner wall element 47, the distance between the inner wall element and the outer wall element 48, and the radial thickness of the outer wall element 48 in the radial direction. Furthermore, the radial thickness of the waist portion 402 may be at least as thick as the sum of the radial thickness of the inner wall element 47 and the distance between the inner wall element and the outer wall element 48, but not as thick as the sum of the radial thickness of the inner wall element 47, the distance between the inner wall element and the outer wall element 48 and the radial thickness of the outer wall element 48 in the radial direction. Thereby, the radial thickness of the waist portion 402 may be less than the distance measured from the inner surface of a through hole 404 centralized in the hub 43 to the outer surface of the outer hub wall element 48. This distance is the same as an outer span measured towards the arms 44 from the surface of the inner hub wall element 47 facing the hole 404 and across the drive ring pocket 64 to the outer surface of the outer hub wall element 48 facing the outer parts of the lower crusher frame portion 42, this distance/span is seen clearly in FIG. 8.

Figure 10:
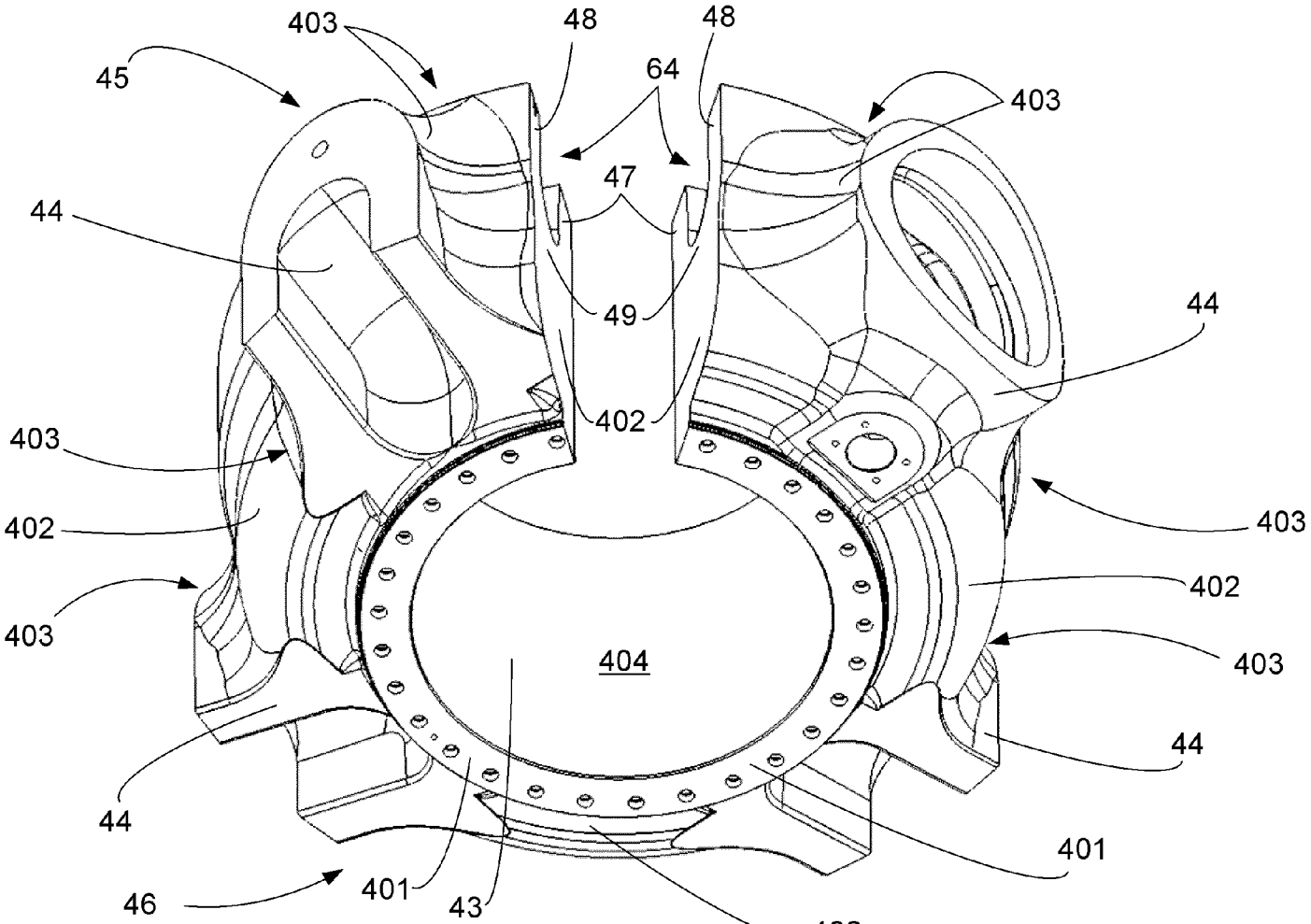
FIG. 10 is a perspective view the lower part of the crusher in FIGS. 8 and 9 from below with a cut out part for clarifying the varying thickness of a waist portion of the lower part of the crusher.

As shown in FIGS. 8 to 10, the radial thickness of the waist portion 402 decreases towards the hub bottom end 46 and the radial thickness of the wall element 401 of the hub bottom end is substantially the same as the radial thickness of the inner wall element 47. The waist portion 402 is arranged between the arms 44 of the lower frame portion 42. This means that the thickness of the hub waist portion 402 is not extended continuously around the periphery of the hub 43, instead the increased thickness of the waist of the hub only extends to, but does not pass by and through the arms, i.e. the waist portion thickness ends at the outer common contacting area of each side of each arm, see FIG. 10. Hence, the thickness of the waist of the hub at the connection between each end of each arm 44, i.e. the cross-section surface of each end of each arm, not the side of the arm facing the sides of the adjacent arms, and the hub outer surface is maintained the same. Hence, the hub waist thickness is unchanged at the area inside each arm 44 by keeping the thickness of the waist area on the hub 43 within the hollow arms, as shown in FIG. 10, the same as in earlier hubs. Hence, the radial thickness of the hub, i.e. the thickness in a radial direction from the centre axis 80 of the through hole 404 centralized in the hub and extending through the hub, varies around its periphery from a larger thickness along the waist portion 402 between the hub arms 44 and all the way into contact with the outer surface of each side of each arm to an unchanged, i.e. smaller thickness, at the end connection area for the arms against the hub. This means that the waist portion 402 is extending discontinuously around the periphery, i.e. the circumference of the hub 43. Each arm 44 works as a disruption of the thickened waist portion 402 along the circumference of the hub.

The inner wall element 47 and the outer wall element 48 of the hub 43 are connected by a bottom wall element 49 (shown in FIGS. 8 and 9) forming the bottom of the drive ring pocket 64. This bottom wall element 49 has a longitudinal thickness, i.e. a thickness in the same direction as the centre axis 80, being larger than the radial thickness of the inner wall element 47 for the hub along each waist portion 402 but has a smaller longitudinal thickness pass each arm as shown in FIG. 9 as all the wall elements 47-49 and 401 extends continuously around the hub circumference. The thickness of the bottom wall element 49 can be seen as being increased or extended downwards in the crusher 10, i.e. in the same direction as the material to be crushed moves through the crusher, from the hub top end 45 towards the hub bottom end 46. The longitudinal thickness of the bottom wall element 49 is smaller than the distance from the bottom of the drive ring pocket 64 to the hub bottom end 46. The thickness or lower outer surface of the drive ring pocket 64 does not have to reach all the way down to the lower edge corner of the hub bottom end 46 as shown in FIGS. 8 to 10, but could reach all the way down if desired.

Each waist portion 402 extends only between its associated arms 44 similar to an arc around the circumference of the hub 43. Each waist portion forms a portion of a circular arc as the hub is cylindrical with a circular cross-section. If three arms 44 are utilized, each waist portion extends less than 120° of the circumference of the hub 43. If four arms are utilized, each waist portion extends less than 90° of the circumference of the hub 43, and if five arms are used, each waist portion extends less than 72° of the circumference of the hub. However, the length or extension of each waist portion arc is restricted by the arms and also by the width of each arm as the arm width occupies a certain distance along the hub circumference.

Each waist portion 402 as shown in FIGS. 7 to 10 has the junction corner at the arms 44 shaped with a certain large radius, but could of course have another contour curve in any direction. This shape of the waist portion is designed as a smoothly smeared out material both downwards in the direction of the hub centre axis 80, see the cross-section shape of the waist portion in FIG. 8, and laterally in the radial direction from the centre axis 80 along the adjoining outer sides of each arm, see FIGS. 9 and 10. This waist curvature makes it possible to stiffen the whole hub and the arms, but also adds material to the hub and the arms so that they are able to carry more load and enables better distribution of the stresses resulting from the increased crusher force, especially the compressive stresses at the arm 44 accommodating the driving device 62.

The invention does not increase the weight of the other parts of the crusher 10 except for the hub 43, i.e. the lower frame portion 43 such that handling, transport, assembly and disassembly of the parts of the crusher is simplified. Furthermore, the preferred thicknesses and location of the waist portion 402 on the hub optimize the sturdiness and rigidity of the hub and the whole crusher without risking making the separate parts and the assembled crusher 10 too "limpy" as the inventive waist portion on the hub increases the ability of the crusher to withstand higher crushing forces "all-over" without having to enlarge the rest of the crusher parts.

10 gyratory crusher
20 feed hopper
30 cylinder-piston arrangement
40 crusher frame
41 upper crusher frame portion
42 lower crusher frame portion
43 crusher frame hub
44 crusher frame arms
45 frame hub top end
46 frame hub bottom end
47 hub top end inner wall element
48 hub top end outer wall element
49 hub top end bottom wall element
401 hub bottom end wall element
402 hub waist portion
403 hub waist portion end
404 hub centre hole
60 vertical shaft
61 eccentric
62 driving device
63 drive ring
64 drive ring pocket
65 drive shaft
70 crushing head
71 first crushing shell
72 second crushing shell
73 crushing gap
80 centre axis through the hub

The invention claimed is:

1. A gyratory crusher comprising:

a frame;

a crushing head arranged rotatably about a substantially vertical shaft, wherein the frame includes an upper frame portion, and a lower frame portion; and a hub formed in the lower frame portion, the hub having a centralized arranged through hole with a center axis extending through said hole and the hub, the hole being arranged to cooperate with the shaft rotatably arranged in said hole, the hub being connected by a plurality of arms to the lower frame portion and including a drive ring pocket, the drive ring pocket being bounded by an inner wall element, an outer wall element of the hub and a bottom wall element, the inner wall, outer wall and bottom wall elements extending continuously around a periphery of the hub, wherein the hub includes a hub bottom end and a waist portion, the waist portion extending discontinuously around the periphery of the hub, wherein at each arm the waist portion extends from the bottom wall element of the drive ring pocket to the hub bottom end and has a height that is larger than a longitudinal height of the bottom wall element, the waist portion having a thickness in a radial direction from the center axis that is larger than a width of the drive ring pocket for the hub.

2. A gyratory crusher according to claim 1, wherein the inner wall element and the outer wall element of the hub are arranged at a distance from each other and the radial thickness of the waist portion is at least as thick as the sum of the radial thickness of the inner wall element and the width of the drive ring pocket.

3. A gyratory crusher according to claim 1, wherein the radial thickness of the waist portion decreases towards the hub bottom end.

4. A gyratory crusher according to claim 2, wherein the hub bottom end includes a wall element that is a prolongation of the inner wall element for the hub in the direction along the center axis, the radial thickness of the wall element of the hub bottom end being substantially the same as the radial thickness of the inner wall element of the hub.

5. A gyratory crusher according to claim 1, wherein the arms of the lower frame portion are hollow and the waist portion is arranged between the arms of the lower frame portion.

6. A gyratory crusher according to claim 5, wherein the waist portion extends in a circumferential direction of the hub to and joins the arms of the lower frame portion.

7. A gyratory crusher according to claim 6, wherein the waist portion extends to and joins each arm of the lower frame portion by a transition section at each waist portion end forming a smooth connection between the waist portion and each arm.

8. A gyratory crusher according to claim 2, wherein the longitudinal height of the bottom wall element is larger than the radial thickness of the inner wall element of the hub.

9. A gyratory crusher according to claim 4, wherein the longitudinal height of the bottom wall element is smaller than the distance from the bottom of the drive ring pocket to the hub bottom end.

* * * * *